US011540583B2

(12) United States Patent
Kele et al.

(10) Patent No.: US 11,540,583 B2
(45) Date of Patent: Jan. 3, 2023

(54) IMPACT ATTENUATING HELMET WITH INNER AND OUTER LINER AND SECURING ATTACHMENT

(71) Applicant: Bell Sports, Inc., Scotts Valley, CA (US)

(72) Inventors: Paul A. Kele, Soquel, CA (US); David T. Debus, Felton, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 232 days.

(21) Appl. No.: 16/849,626

(22) Filed: Apr. 15, 2020

(65) Prior Publication Data

US 2020/0323299 A1 Oct. 15, 2020

Related U.S. Application Data

(60) Provisional application No. 62/833,935, filed on Apr. 15, 2019.

(51) Int. Cl.

| | |
|---|---|
| ***A42B 3/06*** | (2006.01) |
| ***A42B 3/12*** | (2006.01) |
| ***A42B 3/14*** | (2006.01) |
| ***A42B 3/08*** | (2006.01) |

(52) U.S. Cl.

CPC ..... *A42B 3/127* (2013.01); *A42B 3/066* (2013.01); *A42B 3/08* (2013.01); *A42B 3/147* (2013.01)

(58) Field of Classification Search

CPC ..... A42B 3/064; A42B 3/147; A42B 3/10; A42B 3/127; A63B 71/10

See application file for complete search history.

(56) References Cited

U.S. PATENT DOCUMENTS

| | | | | |
|---|---|---|---|---|
| 8,863,319 | B2 * | 10/2014 | Knight | A42B 3/14 2/411 |
| 10,271,603 | B2 * | 4/2019 | Briggs | A42B 3/12 |
| 10,463,099 | B2 * | 11/2019 | Allen | A42B 3/283 |
| 10,602,794 | B2 * | 3/2020 | Thiel | A42B 3/283 |
| 10,834,987 | B1 * | 11/2020 | Bottlang | A42B 3/125 |
| 2004/0250340 | A1 * | 12/2004 | Piper | A42B 3/064 2/412 |
| 2020/0187583 | A1 * | 6/2020 | Allen | A63B 71/10 |
| 2020/0305534 | A1 | 10/2020 | Chilson | |
| 2022/0125148 | A1 * | 4/2022 | McDermott | A42B 3/20 |

* cited by examiner

*Primary Examiner* — Tajash D Patel

(74) *Attorney, Agent, or Firm* — Amardeep S. Grewal; Gerard M. Donovan; Reed Smith LLP

(57) ABSTRACT

An impact attenuating helmet including an outer liner having an inner mating surface, an inner liner positioned under the outer liner and having an outer mating surface configured to be received by the inner mating surface of the outer liner, the inner liner and the outer liner being configured to move relative to each other along a slip plane between outer mating surface of the inner liner and the inner mating surface of the outer liner, and one or more securing attachments, each securing attachment being coupled to the outer liner and being configured to secure the outer liner to the inner liner, each securing attachment comprising a slack element configured to permit a range of movement between the outer liner and the inner liner.

22 Claims, 9 Drawing Sheets

IMPACT ATTENUATING HELMET WITH INNER AND OUTER LINER AND SECURING ATTACHMENT

RELATED APPLICATION DATA

This Application claims priority to U.S. Provisional Application No. 62/833,935, titled "SECURING ATTACHMENT FOR HELMET WITH TWO-PIECE EPS LINERS" and filed Apr. 15, 2019.

BACKGROUND

A physical impact to the head of a person can cause serious injury or death. To reduce the probability of such consequences, protective gear, such as a helmet, is often used in activities that are associated with an increased level of risk for a head injury. Examples of such activities include, but are not limited to, skiing, snowboarding, bicycling, rollerblading, rock climbing, skate boarding, and motorcycling. In general, a helmet is designed to maintain its structural integrity and stay secured to the head of a wearer during an impact.

Accordingly, for example, a bicycle helmet is designed to protect the cyclist's (or wearer's) head, including by absorbing and dissipating energy during an impact with a surface, such as the ground. Bicycle helmet interiors include impact attenuating materials such as an arrangement of padding and/or foam, wherein the impact attenuating materials cover and contact a significant portion of the wearer's head.

However, even with these attenuating materials and layered helmet designs, the user can still suffer injury. In addition, depending on the location of the impact on the helmet, the helmet and/or layers of the helmet, can be completely removed from the user's head, despite the use of chin straps, because of the rigid nature of the helmet and straps that are used.

Accordingly, there is a need for improvements in impact attenuating helmets.

DETAILED DESCRIPTION

Figure 1:
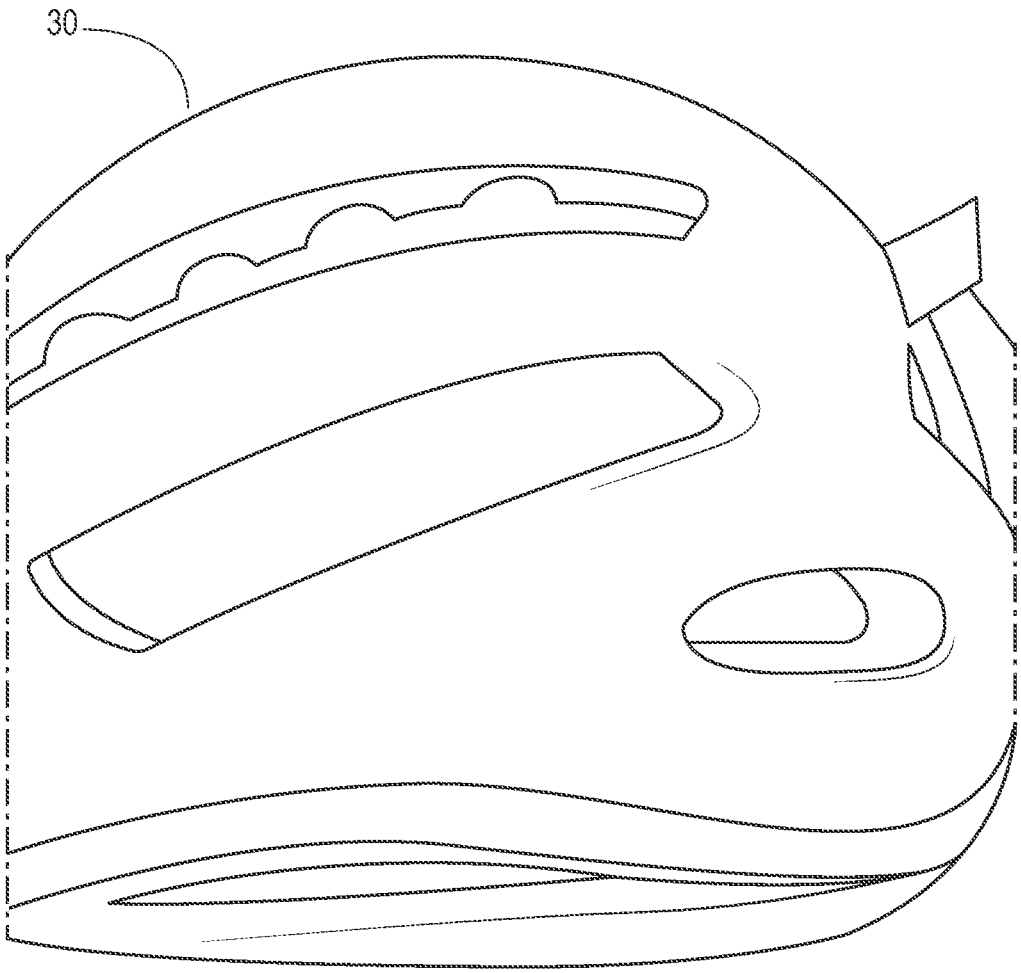
FIG. 1 illustrates an inner liner of an impact attenuating helmet according to an exemplary embodiment.

While structures are described herein by way of examples and embodiments, those skilled in the art recognize that the impact attenuating helmet is not limited to the embodiments or drawings described. It should be understood that the drawings and description are not intended to be limited to the particular form disclosed. Rather, the intention is to cover all modifications, equivalents and alternatives falling within the spirit and scope of the appended claims. Any headings used herein are for organizational purposes only and are not meant to limit the scope of the description or the claims. As used herein, the word "can" is used in a permissive sense (i.e., meaning being able to) rather than the mandatory sense (i.e., meaning must). Similarly, the words "include," "including," and "includes" mean including, but not limited to.

This disclosure, its aspects and implementations, are not limited to the specific material types, components, methods, or other examples disclosed herein. Many additional material types, components, methods, and procedures are contemplated for use with particular implementations from this disclosure. Accordingly, for example, although particular implementations are disclosed, such implementations and implementing components can comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

The present application relates to a helmet comprised of attenuating materials disposed in layers, wherein the layers can slip, or otherwise move with respect to each other. Such slippage, of movement of the layered attenuating materials can provide added protection against rotational motion (or kinematics) transmitted to the brain from angled impacts (or multi-directional impacts) to the head.

Applicant has invented a novel impact attenuating helmet with securing attachment(s) provided to prevent movement of layered impact-attenuating material liners beyond a set distance with respect to each other during an impact event. The helmet can be any type or style of helmet, such as a cycling helmet, a skiing helmet, a snowboarding helmet, a skateboarding helmet, a motorcycle helmet, etc.

The impact attenuating helmet includes an outer liner having an inner mating surface and an inner liner positioned under the outer liner and having an outer mating surface configured to be received by the inner mating surface of the outer liner.

As used herein the term "mating" surface is not intended to denote an immobile or fixed mating or coupling between the inner and outer liners. Rather, the outer mating surface of the inner liner is configured to be received within the inner mating surface of the outer line such that the inner liner fits within the outer liner but remains movable (to slide, rotate, etc.) with respect to the outer liner.

The outer liner can form the exterior of the impact attenuating helmet. Alternatively, one or more layers of the helmet can also be disposed outside the outer liner, such as fabric, plastic, or other layers.

The inner liner and/or the outer liner can be constructed of a crushable foam and/or a thermoplastic or some combination of the two. For example, the inner liner and/or the outer liner can be constructed from one or more of expanded polystyrene, expanded polypropylene, and/or polycarbonate.

The inner mating surface and/or the outer mating surface can be substantially spherical or can be other shapes, such as a spheroid shape, an ovoid shape, an ellipsoid shape, or some combination of shapes.

The inner liner and the outer liner are configured to move relative to each other along a slip plane between outer mating surface of the inner liner and the inner mating surface of the outer liner. The slip plane can be considered the boundary between the outer mating surface of the inner liner and the inner mating surface of the outer liner.

To facilitate ease of movement along the slip plane, one or more of the inner mating surface or the outer mating surface can be constructed of thermoplastic surface that is optionally coated with a low friction coating.

The impact attenuating helmet also include one or more securing attachments, each securing attachment being coupled to the outer liner and being configured to secure the outer liner to the inner liner. Optionally, one or more of the securing attachments can also be coupled to the inner liner and/or pass through the inner liner, as will be discussed below in greater detail.

As will be explained further below, each securing attachment includes a slack element or slack component configured to permit a range of movement between the outer liner and the inner liner. The slack element permits a limited amount of motion between the inner and outer liner before the securing mechanisms of the securing attachment prevent further movement. For example, the slack element can be an elastic component, a length of cord, or any other structure that permits some degree of relative motion between the inner liner and the outer liner. For example, the slack element can be configured to limit a range of movement of the outer liner with respect to the inner liner to between 10-15 millimeters, inclusive.

A variety of different implementations are discussed below. Generally, these implementations can comprise an outer liner, an inner liner movable with respect to the outer liner along a slip plane existent between the inner outer liner and the inner liner, and a securing attachment configured to secure the outer liner to the inner liner and prevent movement of the outer liner with respect to the inner liner beyond a set distance.

Such implementations generally function by allowing the outer liner to rotate, slip or otherwise move in relation to the inner liner. This dynamic movement of the layered helmet components can help to limit injuries upon impact because more of the impact energy, for example energy associated with rotational or kinematic motion, is absorbed than with a conventional impact attenuating helmet. It should be understood that the components depicted and discussed are non-limiting examples, and that the contemplated components can be combined with any of the other components in other implementations.

Implementations of the presently disclosed impact attenuating helmet can include two or more impact-attenuating liners stacked, or layered, on top of each other. Each liner can be made of a crushable foam such as expanded polystyrene ("EPS"), expanded polypropylene ("EPP"), and/or a thermoplastic such as polycarbonate. For particular implementations identified herein, the liners have mating surfaces, wherein the mating surfaces can be aligned along a slip plane, and further wherein the aligned mating surfaces can, to an extent, help reduce friction and aid in allowing the liner surfaces to rotate, slip or otherwise move in relation to each other in any direction, primarily within the slip plane. The mating surfaces can be substantially spherical or pseudo-spherical and can include extended non-spherical portions, such as portions corresponding to the occipital region of the head when the helmet is worn by a user. The mating surfaces can also more closely conform in shape to a typical profile of a human head.

FIG. 1 illustrates an inner liner of an impact attenuating helmet according to an exemplary embodiment. As shown in FIG. 1, the inner liner 30 can have an outer mating surface which is substantially spherical.

Figure 2:
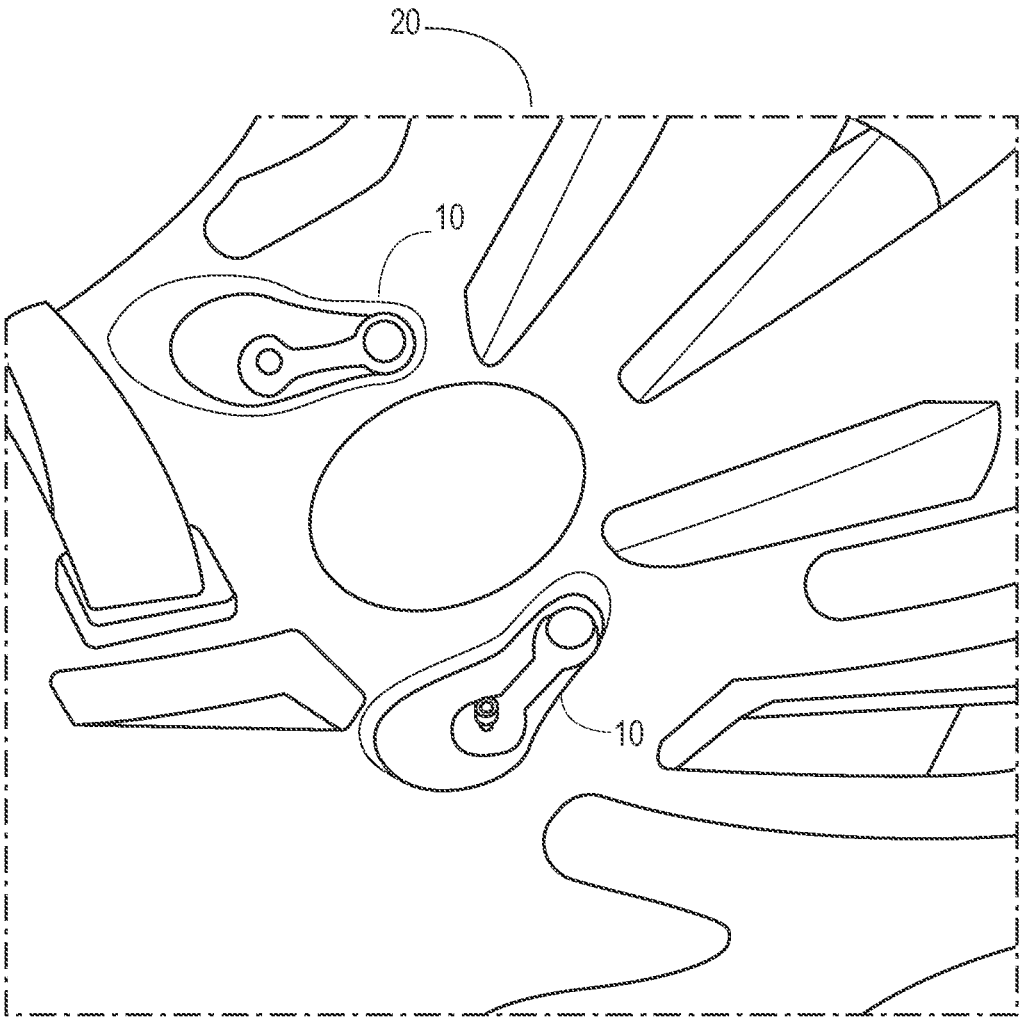
FIG. 2 illustrates an outer liner of an impact attenuating helmet according to an exemplary embodiment.

FIG. 2 illustrates an outer liner of an impact attenuating helmet according to an exemplary embodiment. As shown in FIG. 2, the inner mating surface of the outer liner 20 can also be substantially spherical and correspond dimensioned and geometry with the outer mating surface of the inner liner implementation shown in FIG. 1. Other implementations can mimic shapes with other curved surfaces which allow a similar rotation, such as a spheroid, ovoid, or ellipsoid. In some implementations, the outer mating surface of the inner liner can also be made with a thermoplastic such as polycarbonate, as further illustrated in FIG. 1. This thermoplastic can be coated with a low friction coating to help further reduce the friction between the two mating surfaces.

As shown in FIG. 2, the securing attachments can include an elastomeric straps 10 configured to be attached to the outer liner 20 at an outer liner attachment point and configured to be attached to the inner liner at an inner liner attachment point. In this case, the slack element is a region of the elastomeric strap 10 between the outer liner attachment point and the inner liner attachment point.

The elastomeric straps can stretch, or otherwise deform, to allow the outer liner to move with respect to the inner liner. In addition, the elastomeric straps can help pull the outer liner back to the outer liner's original position with regard to the inner liner, once a force causing the deformation is removed. The elastomeric strap can be used to couple the inner and outer liners together at various points located along the slip plane of the mating surfaces and/or along the lower edge of the helmet.

Figure 3:
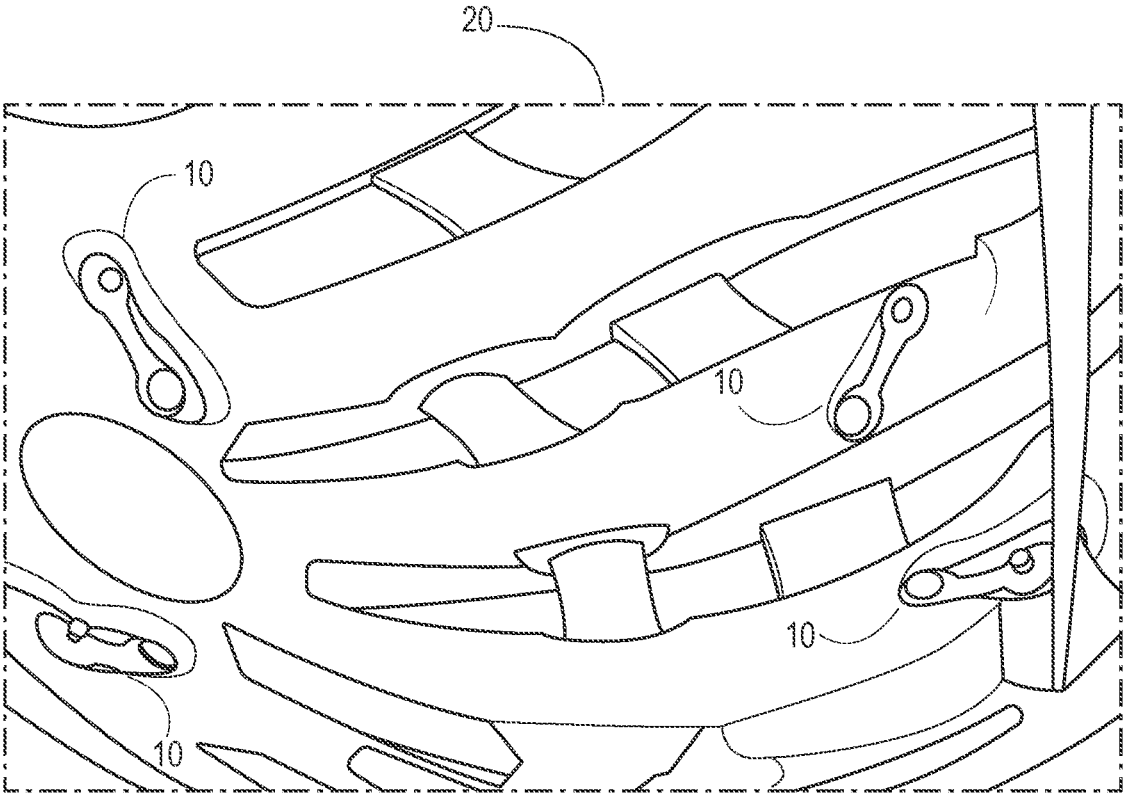
FIG. 3 illustrate a inner surface of an outer line having four elastomeric straps according to an exemplary embodiment.

FIG. 3 illustrate a inner surface of an outer liner 20 having four elastomeric straps 10 according to an exemplary embodiment. As illustrated, the four elastomeric straps can be spaced around the inside surface of the outer liner. The outer liner is free to move with respect to the inner liner because the outer liner and inner liner are not directly connected. However, the motion of the outer liner is constrained by the extent to which the elastomeric strap(s) can deform or stretch.

The provision of a helmet incorporating two layered impact-attenuation liners presents certain challenges. For instance, it is important to create a slip plane commensurate with the mating surfaces of the two liners that will allow requisite movement between the inner and outer liners but will also facilitate secure attachment of both liners to the helmet, in general respect to the slip plane, during an impact event. In other words, design implementations can be provided to facilitate a way to secure both the inner and outer liners for helmets utilizing elastomeric straps, wherein the elastomeric straps can become damaged or destroyed by forces presented during an impact, or for helmets with inner and outer liners oriented with mating surfaces movable about a slip plane that do not incorporate elastomeric straps. As such, an effective design consideration involves permanently affixing a securing attachment to the outer liner and at least passing it through and/or attaching it to the inner liner, thereby securing both liners in the event of an impact.

Figure 4:
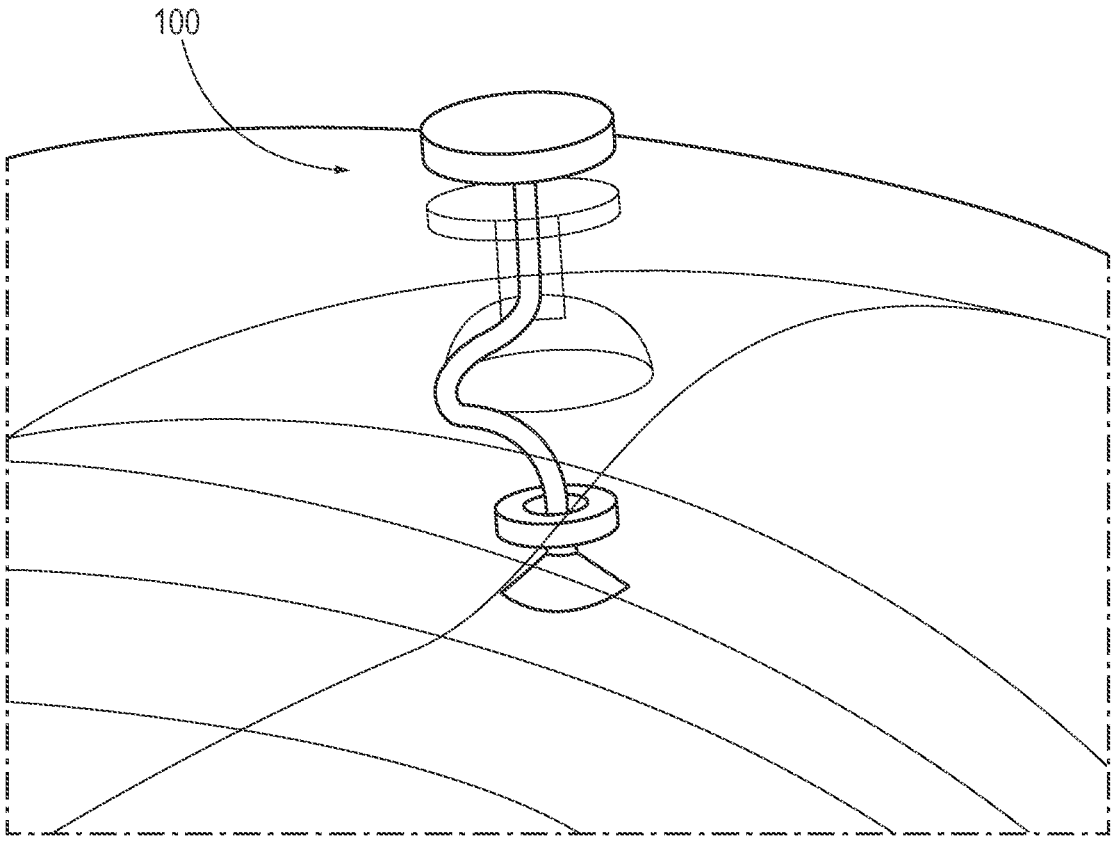
FIG. 4 illustrates a leash anchor securing attachment according to an exemplary embodiment.

The securing attachments can also include a leash anchor coupled to the outer liner and to the inner liner. As explained below, the slack element for this type of securing attachment is a length of cord between two ends of the leash anchor. FIG. 4 illustrates a leash anchor securing attachment according to an exemplary embodiment. Leash anchor 100 comprising a leash, such as a length of cord, which is anchored, or otherwise attached in some manner, to both the inner and outer liners.

Figure 5:
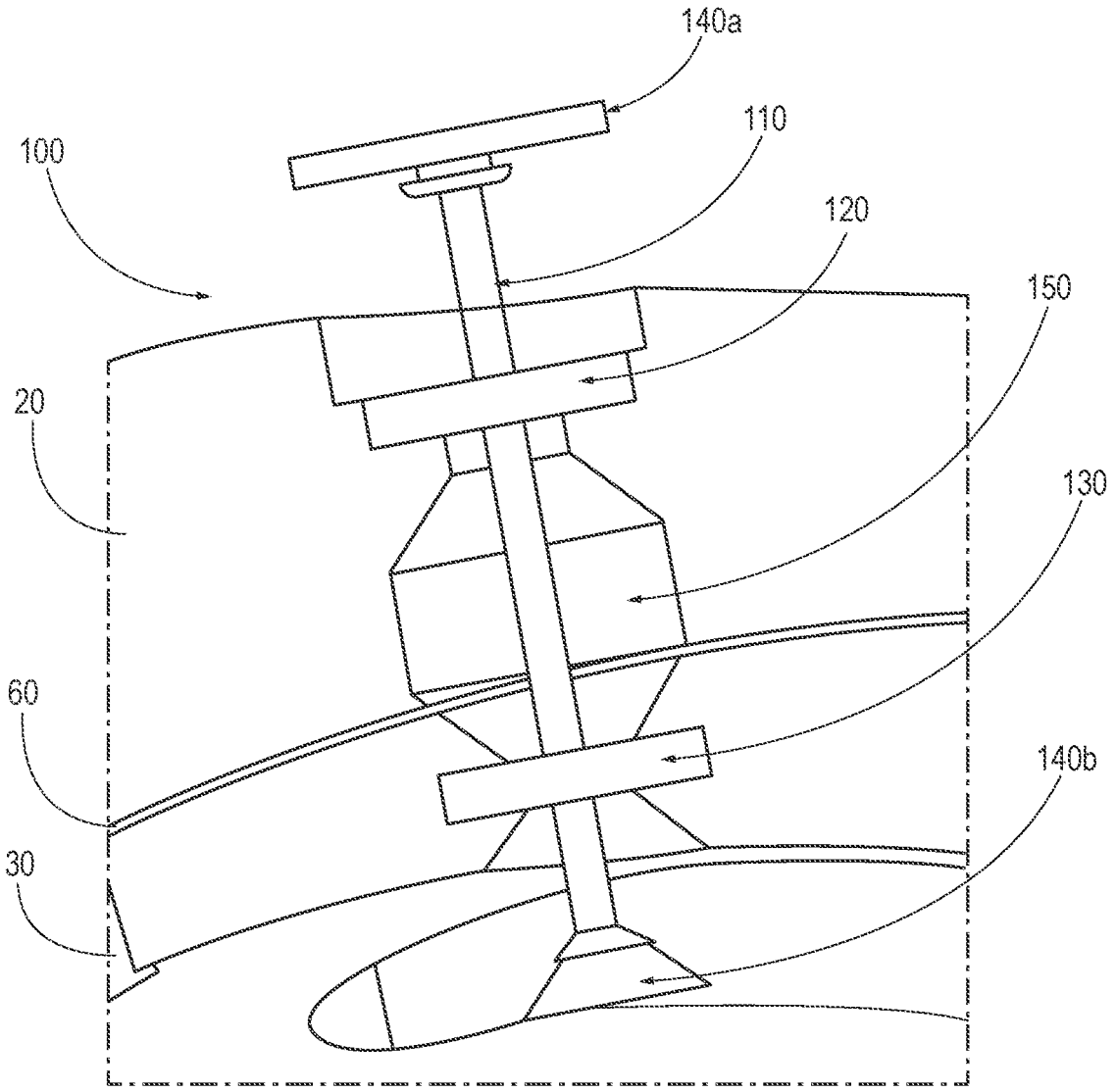
FIG. 5 illustrates a leash anchor in an unassembled state according to an exemplary embodiment.
Figure 6:
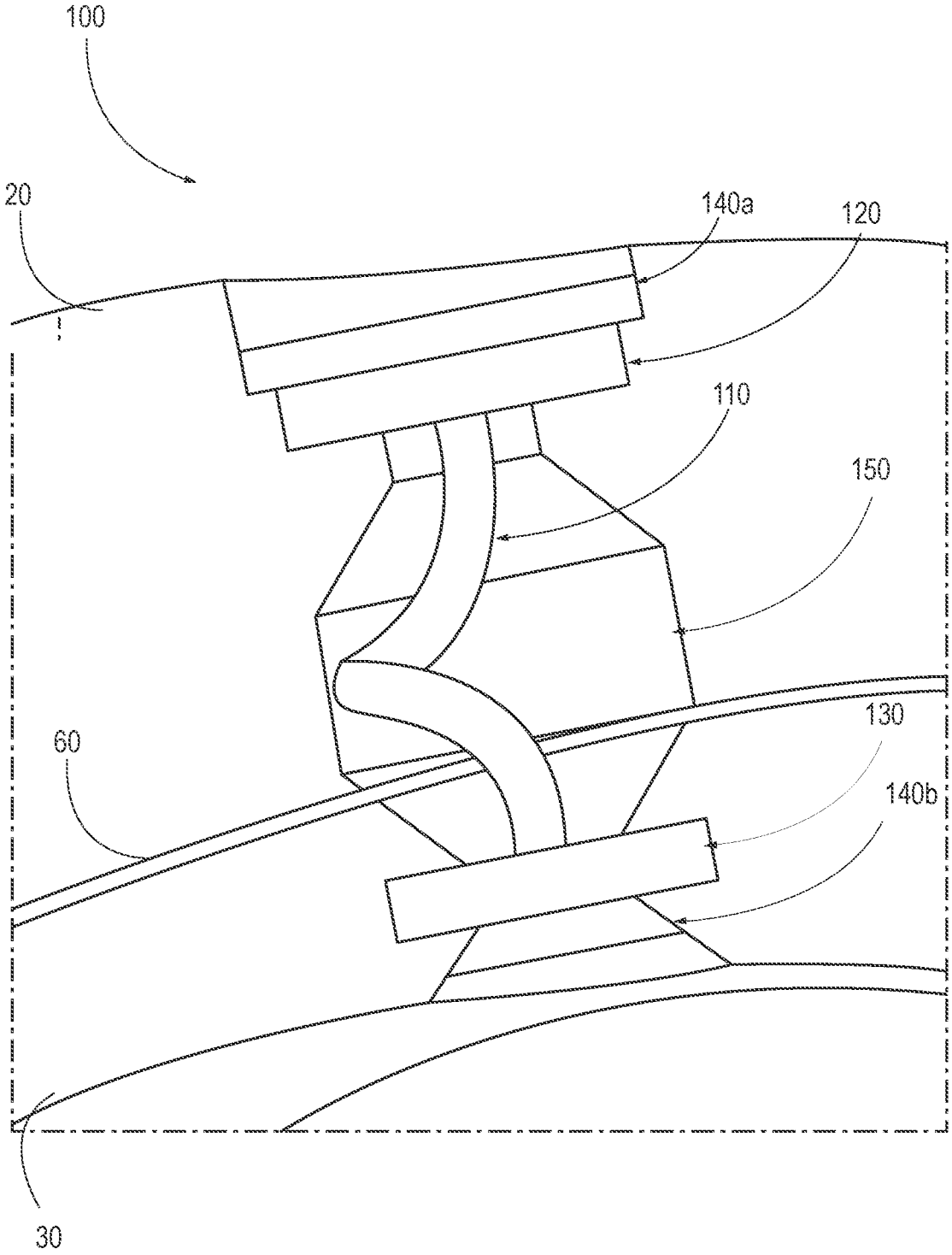
FIG. 6 illustrates a leash anchor in an assembled state and with excess slack according to an exemplary embodiment.

FIG. 5 illustrates a leash anchor in an unassembled state according to an exemplary embodiment. FIG. 6 illustrates a leash anchor in an assembled state and with excess slack according to an exemplary embodiment. As shown in FIGS. 5-6, the leash anchor 100 can comprise a leash cord 110. The leash cord 110 can be configured to have a predetermined length. This predetermined length of the leash cord 100 can facilitate an amount of slack in the leash anchor 100, thereby allowing for a degree of movement between the inner outer liner 20 and the inner liner 30 of the helmet.

The leash cord 110 can be injection molded ("inmolded") in the outer liner 20, the inner liner 30, or both liners of the helmet. Moreover, the leash cord 110 can be included in a leash anchor 100 that is assembled after molding a permanent affixing feature into one or both of the liners 20 and/or 30. For example, an outer liner snap receptacle 120 can be molded into the outer liner 20 and can be configured to connect to, snap together with, or otherwise fasten to a cord anchor snap, such as outer liner cord anchor snap 140*a*, thereby securely fastening the leash cord 110 to the outer liner 30.

Likewise, an inner liner snap receptacle 130 can be molded into the inner liner 30 and can be configured to connect to, snap together with, or otherwise fasten to a cord anchor snap, such as inner liner cord anchor snap 140*b*, thereby securely fastening the leash cord 110 to the inner liner 30. In this manner, the leach anchor 100 can be securely connected to both the outer liner 20 and the inner liner 30.

A cavity 150 or other hollow space or opening, can be molded into one or both of the outer liner 20 and the inner liner 30, and can be configured to store at least a portion of the predetermined length of anchor cord 110. The cavity 150 can be molded or otherwise formed in such a way to allow for excess slack of the leash cord to be contained therein, without interfering with the intended slipping functionality of the matting outer 20 and inner 30 liners of the helmet. If an event, such as a crash by a rider wearing the helmet, occurs and results in forces causing the outer liner 20 to slip along the slip plane 60 and move relative to the inner liner 30 then the leash cord 110 can extend out of the cavity 150 allowing slippage and movement until the leash cord 110 is fully extended, at which point the leash cord 110 will restrict further movement of the outer liner 20 with respect to the inner liner 30. As such, the leash anchor 100 will facilitate a maximum range of movement of the outer liner 20 with respect to the inner liner 30.

In addition, the leash anchor can be comprised of materials and attached to the outer liner 20 and inner liner 30 in a manner that is secure and can withstand substantial impact forces. Thus, in the event that an impact evokes forces that might potentially by strong enough to break the outer liner 20 out of layered alignment with the inner liner 30, such as if an embodiment having elastomeric straps was impacted hard enough to break the straps, the anchor leash 100 would facilitate a safety measure and help ensure that the outer liner 20 and inner liner 30 do not break too far out of layered alignment with each other, thereby maintaining a more safe functionality of the helmet.

When the leash anchor 100 is fully assembled and attached to a helmet, the various component elements of the leash anchor 100 can be structurally and functionally secure, but can permit a range of movement of the outer liner 20 with respect to the inner liner 30. For instance, the predetermined length of the leash cord 110, and the slack existent with the leash anchor 100, as attached to the helmet in a defined location, can allow for 10-15 mm of movement of the outer liner 20 with regard to the inner liner 30.

As described previously, the securing attachment for a helmet can be affixed to the outer liner and include elements that pass through and/or attach to the inner liner, thereby securing both liners in the event of an impact. The securing attachment can be, for example, a webbing coupled to the outer liner and extending through a void passage in the inner liner. The slack element for this type of securing attachment would be at least a portion of the webbing itself.

Figure 7:
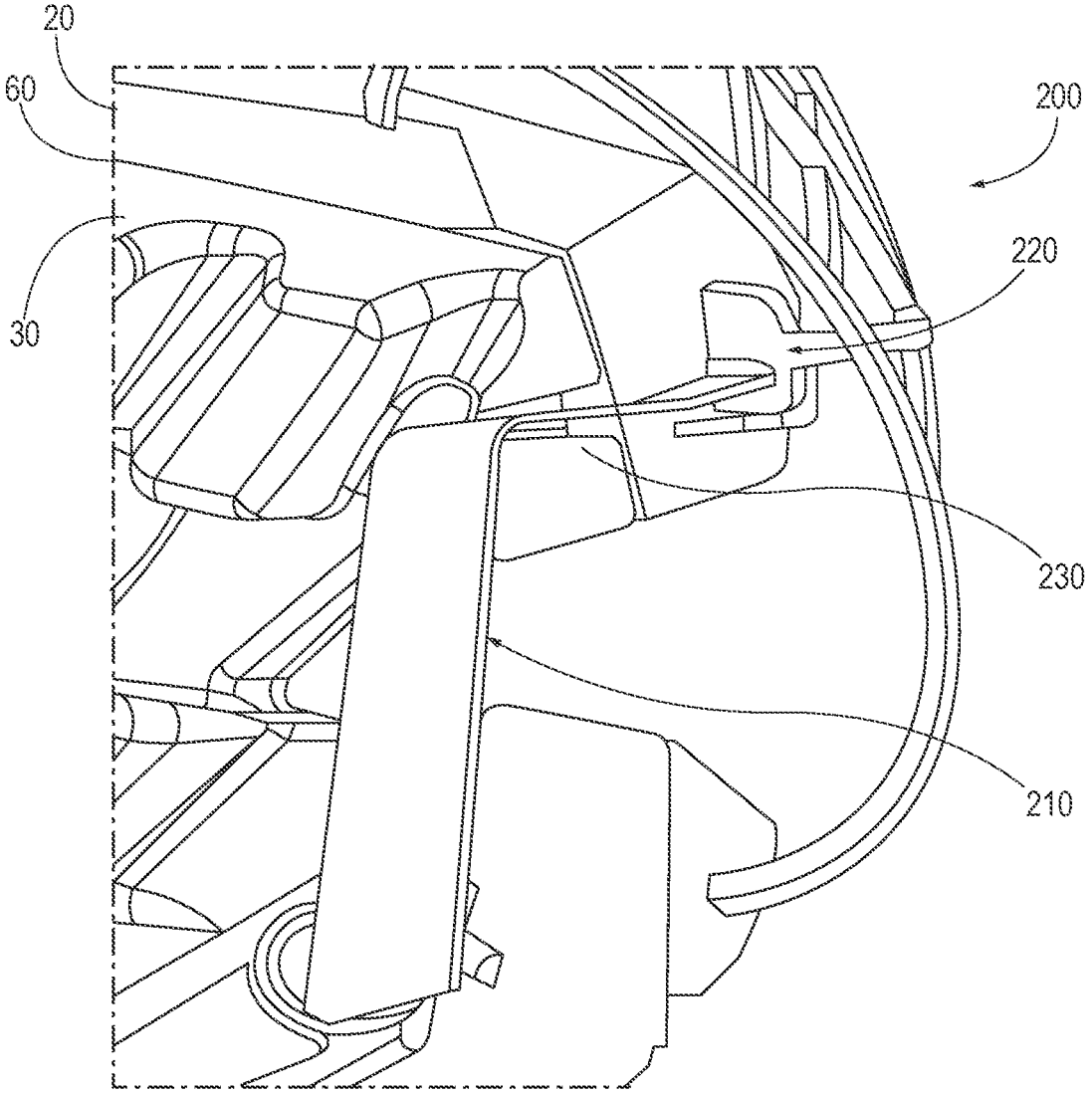
FIG. 7 illustrates a webbing-based securing attachment according to an exemplary embodiment.

FIG. 7 illustrates a webbing-based securing attachment according to an exemplary embodiment. The securing attachment 200 can utilize a webbing 210, such as typical straps used to strap a helmet onto the head of a wearer, wherein the webbing 210 can be permanently affixed to the outer liner 20 of the helmet.

As further shown in FIG. 7, a webbing affixing member 220, can be inmolded into, or otherwise secured onto, the outer liner 20 of the helmet, and the webbing 210 can be attached thereto, thereby permanently securing the webbing 210 to the webbing affixing member 220. The webbing 210 can extend from the outer liner 20 and through a void passage 230, or opening, through the inner liner 30. As depicted in FIG. 7, the location of the webbing 210 can approximate the routing existent when the helmet is on a user's head and the webbing 210 is utilized to affix the helmet to the user's head. The webbing can therefore be configured to secure the impact attenuating helmet to a head of a user. The void passage 230 through the inner liner 30, can be configured to allow the webbing 210, when extended through void passage 230, to freely move in and out of the void passage 230.

This freedom of movement of the webbing 210 through the void passage 230 can permit the layered impact-attenuating outer liner 20 to move freely along the slip plane 60, with respect to the impact-attenuating inner liner 30. However, the extent of movement of the webbing 210 through the inner liner 30 can be limited to, for example, between 10-15 mm, thereby providing a maximum range of movement of the outer liner 20 with respect to the inner liner 30 and preventing movement of the liner beyond that range. The leash anchor 100 described earlier can also be used in combination with the webbing 210 extending through the void passage 230 of the inner liner 30 to attach directly to the outer liner 20 so that the leash anchor 100 limits the maximum range of movement and the webbing 210 maintains the outer liner 20 attached to the inner liner 30 in the event of a more severe impact.

This maximum range of movement can help ensure that both layered halves, or liners 20 and 30, of the helmet can stay assembled in the event of an impact, even with regard to helmets including elastomeric straps where the elastomeric straps can break or otherwise fail, or where even helmets that include an anchor leash and the anchor leash fails. Thus a securing attachment 200, can provide a connecting member, such as a leash cord 110 or a webbing 210 portion, with enough slack to help facilitate proper and substantially unencumbered functionality of the slippable movement of the outer and inner liners 20 and 30, but can also function as a failsafe device to help ensure that the sliding liner parts of the helmet remain properly in place during an impact event.

Too much movement or separation of the outer liner 20 from the inner liner 30 of the helmet can cause the impact attenuating features of the helmet to be diminished or nullified. Moreover, if the outer liner 20 completely or partially detaches from the inner liner, or vice versa, then the impact attenuating features of the helmet can also be reduced or negated. Hence, an important feature of a securing attachment of a helmet with a two-piece EPS liner design, can be the ability of the securing attachment, such as leash anchor 100 or a securing attachment 200 embodiment, to facilitate proper movement of the two EPS liners, while also providing a maximum range of movement to ensure proper helmet functionality during an impact event.

Figure 8:
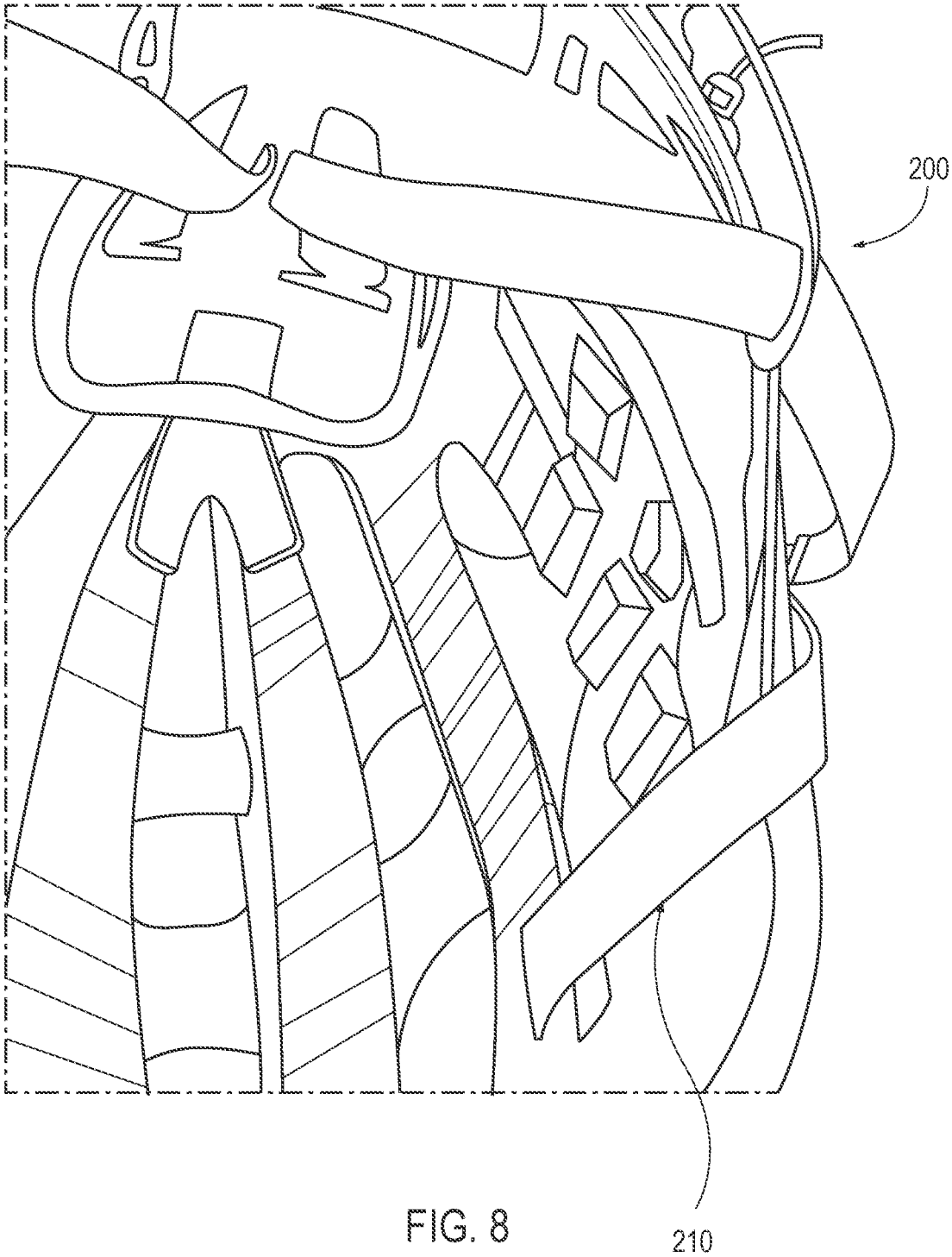
FIG. 8 illustrates an interior view of a helmet incorporating a securing attachment according to an exemplary embodiment.

FIG. 8 illustrates an interior view of a helmet incorporating a securing attachment according to an exemplary embodiment. The webbing-based securing attachment 200, including webbing 210, can be securely mounted to the outer liner of the helmet and then passed through an opening or void of the inner liner of the helmet, so as to facilitate flexible/movable co-location of the inner liner of the helmet with the outer liner of the helmet, but also help prevent detachment from or excessive movement of the inner liner with respect to the outer liner of the helmet.

It will be understood by those of ordinary skill in the art that there are various ways by which the webbing, or leash component, can be securely affixed or otherwise attached to the outer liner. For example, the webbing can be directly molded into the outer liner, it can be connected to a component that is fasted to the outer liner by means of an adhesive, it can be fastened to a component on the exterior of the outer liner, and/or it can be fastened to a component, such as a webbing affixing member 220 (see FIG. 7), that can be inmolded into the outer liner.

Figure 9:
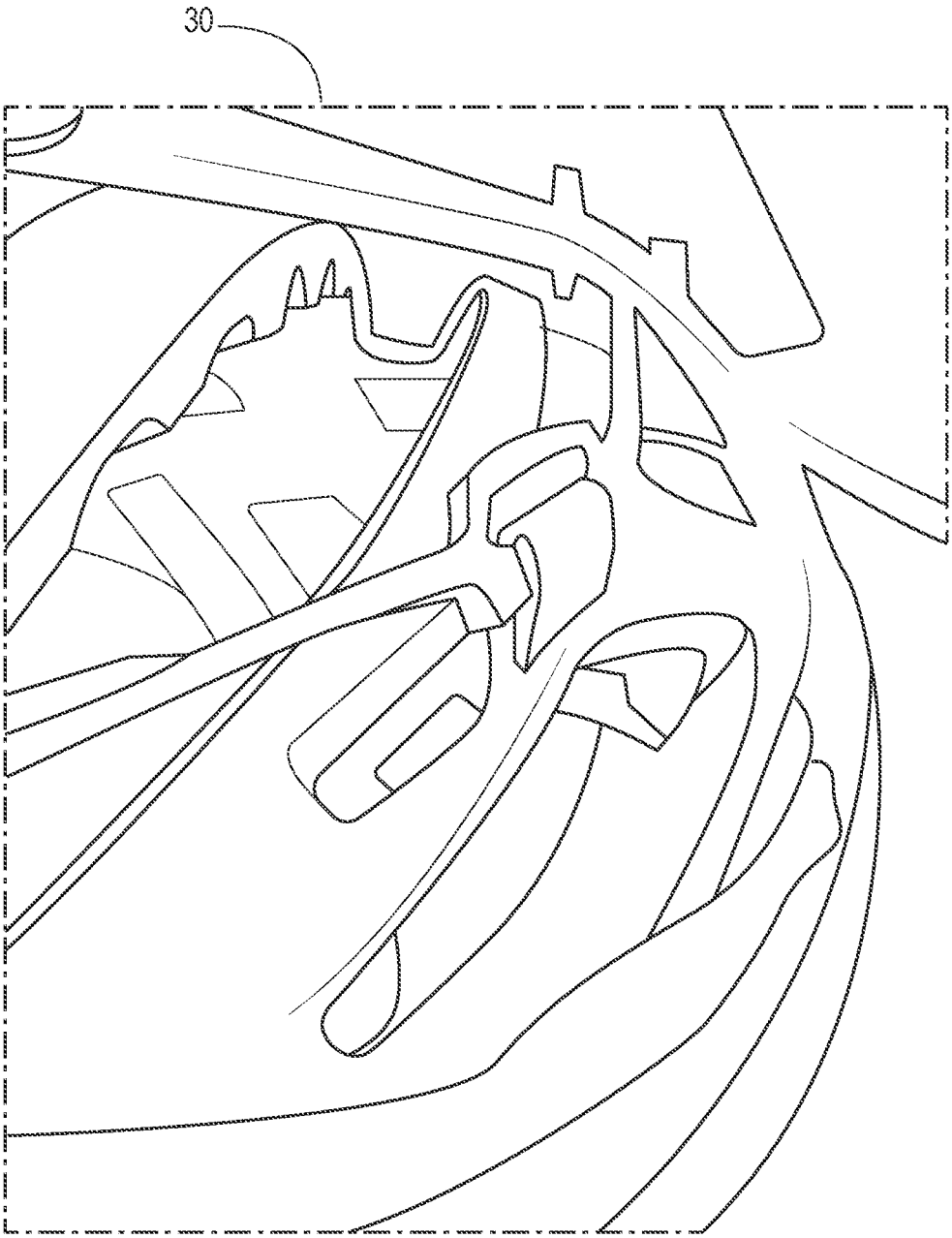
FIG. 9 illustrates an inner liner according to an exemplary embodiment.

FIG. 9 illustrates an inner liner according to an exemplary embodiment. As shown in FIG. 9, the outer EPS liner of the helmet has been removed to show the inner EPS liner rollcage. As depicted, the webbing passes freely through the inner EPS liner. Once extended through the inner EPS liner, the webbing can be securing attached to the outer liner in any manner as described herein, or any manner operably functional for securely attaching the webbing to the outer liner.

It will be understood that impact attenuating helmet implementations are not limited to the specific components disclosed herein, as virtually any components consistent with the intended operation of the various impact attenuating helmet implementations can be utilized. Accordingly, for example, it should be understood that, while the drawings and accompanying text show and describe particular impact attenuating helmet implementations, any such implementation can comprise any shape, size, style, type, model, version, class, grade, measurement, concentration, material, weight, quantity, and/or the like consistent with the intended operation of impact attenuating helmet implementations.

The concepts disclosed herein are not limited to the specific impact attenuating helmet implementations shown herein. For example, it is specifically contemplated that the components included in particular impact attenuating helmet implementations can be formed of any of many different types of materials or combinations that can readily be formed into shaped objects and that are consistent with the intended operation of the impact attenuating helmet implementations. For example, the components can be formed of: silicones and/or other like materials; rubbers (synthetic and/or natural) and/or other like materials; elastomers and/or other like materials; polymers and/or other like materials; plastics and/or other like materials; composites and/or other like materials; and/or any combination of the foregoing.

Furthermore, impact attenuating helmet implementations can be manufactured separately and then assembled together, or any or all of the components can be manufactured simultaneously and integrally joined with one another. Manufacture of these components separately or simultaneously, as understood by those of ordinary skill in the art, can involve extrusion, pultrusion, vacuum forming, injection molding, blow molding, resin transfer molding, and/or the like. If any of the components are manufactured separately, they can then be coupled or removably coupled with one another in any manner, such as with adhesive, a plastic weld, a fastener, any combination thereof, and/or the like for example, depending on, among other considerations, the particular material(s) forming the components.

In places where the description above refers to particular impact attenuating helmet implementations, it should be readily apparent that a number of modifications can be made without departing from the spirit thereof and that these implementations can be applied to other implementations disclosed or undisclosed. The presently disclosed impact attenuating helmet implementations are, therefore, to be considered in all respects as illustrative and not restrictive.

Having described and illustrated the principles of our invention with reference to the described embodiment, it will be recognized that the described embodiment can be modified in arrangement and detail without departing from such principles. It should be understood that the programs, processes, or methods described herein are not related or limited to any particular type of computing environment, unless indicated otherwise. Elements of the described embodiment shown in software can be implemented in hardware and vice versa.

In view of the many possible embodiments to which the principles of our invention can be applied, we claim as our invention all such embodiments as can come within the scope and spirit of the following claims and equivalents thereto.

What is claimed is:

1. An impact attenuating helmet comprising:

an outer liner having an inner mating surface;

an inner liner positioned under the outer liner and having an outer mating surface configured to be received by the inner mating surface of the outer liner, wherein the inner liner and the outer liner are configured to move relative to each other along a slip plane forming a direct interface between the outer mating surface of the inner liner and the inner mating surface of the outer liner; and one or more securing attachments, each securing attachment being coupled to the outer liner and the inner liner and being configured to secure the outer liner to the inner liner, wherein each securing attachment comprises a slack element extending from the outer liner to the inner liner and being configured to permit a range of movement between the outer liner and the inner liner.

2. The impact attenuating helmet of claim 1, wherein an exterior of the outer liner forms an exterior of the impact attenuating helmet.

3. The impact attenuating helmet of claim 1, wherein the outer liner comprises one or more of a crushable foam or a thermoplastic.

4. The impact attenuating helmet of claim 3, wherein the outer liner comprises one or more of expanded polystyrene, expanded polypropylene, or polycarbonate.

5. The impact attenuating helmet of claim 1, wherein the inner liner comprises one or more of a crushable foam or a thermoplastic.

6. The impact attenuating helmet of claim 5, wherein the inner liner comprises one or more of expanded polystyrene, expanded polypropylene, or polycarbonate.

7. The impact attenuating helmet of claim 1, wherein the inner mating surface and the outer mating surface are substantially spherical.

8. The impact attenuating helmet of claim 1, wherein the inner mating surface and the outer mating surface are one of: a spheroid shape, an ovoid shape, or an ellipsoid shape.

9. The impact attenuating helmet of claim 1, wherein one or more of the inner mating surface or the outer mating surface comprise a thermoplastic surface.

10. The impact attenuating helmet of claim 9, wherein the thermoplastic surface is coated with a low friction coating.

11. The impact attenuating helmet of claim 1, wherein the one or more securing attachments comprise an elastomeric strap coupled to the outer liner at an outer liner attachment point and to the inner liner at an inner liner attachment point and wherein the slack element comprises a region of the elastomeric strap between the outer liner attachment point and the inner liner attachment point.

12. The impact attenuating helmet of claim 1, wherein the one or more securing attachments comprise a leash anchor coupled to the outer liner and to the inner liner and wherein the slack element comprises a length of cord between two ends of the leash anchor.

13. The impact attenuating helmet of claim 12, wherein one or more of the outer line or the inner liner comprise a cavity configured to store at least a portion of the length of cord.

14. The impact attenuating helmet of claim 12, wherein the leash anchor is molded into one or more of the outer liner or the inner liner.

15. The impact attenuating helmet of claim 12, wherein the leash anchor comprises one or more anchor snaps configured to connect to one or more snap receptacles molded into one or more of the outer liner or the inner liner.

16. The impact attenuating helmet of claim 1, wherein the one or more securing attachments comprise a webbing coupled to the outer liner and extending through a void passage in the inner liner and wherein the slack element comprises at least a portion of the webbing.

17. The impact attenuating helmet of claim 16, wherein the webbing is configured to secure the impact attenuating helmet to a head of a user.

18. The impact attenuating helmet of claim 16, wherein the webbing is molded into the outer liner.

19. The impact attenuating helmet of claim 16, wherein the webbing is coupled to the outer liner via a webbing affixing member secured onto the outer liner.

20. The impact attenuating helmet of claim 1, wherein the slack element is configured to limit a range of movement of the outer liner with respect to the inner liner to between 10-15 millimeters, inclusive.

21. An impact attenuating helmet comprising:

an outermost liner having an inner mating surface;

an innermost liner positioned under the outermost liner and having an outer mating surface configured to be received by the inner mating surface of the outermost liner, wherein the innermost liner and the outermost liner are configured to move relative to each other along a slip plane forming a direct interface between the outer mating surface of the innermost liner and the inner mating surface of the outermost liner; and one or more securing attachments, each securing attachment being coupled to the outermost liner and the innermost liner and being configured to secure the outermost liner to the innermost liner, wherein each securing attachment comprises a slack element extending from the outermost liner to the innermost liner and being configured to permit a range of movement between the outermost liner and the innermost liner.

22. An impact attenuating helmet comprising:

an outer liner having an inner mating surface;

an inner liner positioned under the outer liner and having an outer mating surface configured to be received by the inner mating surface of the outer liner, wherein the inner liner and the outer liner are configured to move relative to each other along a slip plane forming a direct interface between the outer mating surface of the inner liner and the inner mating surface of the outer liner; and one or more securing attachments, each securing attachment being coupled to the outer liner and being configured to secure the outer liner to the inner liner, wherein each securing attachment comprises a slack element extending at least partially through the inner liner and being configured to permit a range of movement between the outer liner and the inner liner.

* * * * *